US005359166A

United States Patent [19]

Elsaesser et al.

[11] Patent Number: 5,359,166

[45] Date of Patent: Oct. 25, 1994

[54] KEYBOARD, ESPECIALLY FOR ELECTRONIC DATA-PROCESSING APPARATUSES

[75] Inventors: Heinz Elsaesser, Rietheim-Weilheim; Kurt Klaiber, Spaichingen; Ralf Sauer, Wurmlingen, all of Fed. Rep. of Germany

[73] Assignee: Marquardt GmbH, Rietheim-Wilheim, Fed. Rep. of Germany

[21] Appl. No.: 968,407

[22] PCT Filed: Apr. 17, 1991

[86] PCT No.: PCT/DE91/00322

§ 371 Date: Oct. 29, 1992

§ 102(e) Date: Oct. 29, 1992

[87] PCT Pub. No.: WO91/17557

PCT Pub. Date: Nov. 14, 1991

[30] Foreign Application Priority Data

Apr. 30, 1990 [DE] Fed. Rep. of Germany ..... 4013819

[51] Int. Cl.[5] ..... H01H 13/70

[52] U.S. Cl. ..... 200/5 A; 200/305; 361/212; 361/680; 361/816; 361/818

[58] Field of Search ..... 200/5 A, 304, 305, 512–517; 235/145 R; 361/680, 681, 212–220, 816, 818, 829, 832

[56] References Cited

U.S. PATENT DOCUMENTS

| | | | |
|---|---|---|---|
| 3,657,492 | 4/1972 | Arndt et al. | 200/5 R |
| 4,056,699 | 11/1977 | Jordan | 200/5 A |
| 4,303,960 | 12/1981 | Sherwood et al. | 361/212 |
| 4,336,529 | 6/1982 | Buan | 200/5 A X |
| 4,671,688 | 6/1987 | Brashears | 400/714 |
| 4,689,608 | 8/1987 | Bolda et al. | 200/5 A X |
| 4,814,566 | 3/1989 | Sigl | 200/305 |
| 4,864,077 | 9/1989 | Wadell | 174/35 R |
| 5,193,047 | 3/1993 | Barratt et al. | 361/212 |

FOREIGN PATENT DOCUMENTS

| | | |
|---|---|---|
| 2032408 | 1/1972 | Fed. Rep. of Germany . |
| 3228398 | 6/1986 | Fed. Rep. of Germany . |
| 8801425.8 | 5/1988 | Fed. Rep. of Germany . |
| 3340749 | 7/1988 | Fed. Rep. of Germany . |
| 8809392.1 | 11/1988 | Fed. Rep. of Germany . |
| 3632831 | 10/1989 | Fed. Rep. of Germany . |
| 2571889 | 4/1986 | France . |

*Primary Examiner*—J. R. Scott

*Attorney, Agent, or Firm*—Spencer, Frank & Schneider

[57] ABSTRACT

A keyboard for electronic equipment screens off RF radiation by using a conductive housing (2), preferably made of extruded aluminum, which is closed off at its two ends by conductive end pieces (25) and which is closed off underneath by a conductive base plate (30). Key switches (9) extend through openings in a conductive frame (15) that is mounted inside the housing (2), which itself has openings (5, 6) for passage of the key switches (9). The elements are configured to reduce the level of any RF radiation that escapes from inside the keyboard. Among other advantages, this reduction of escaping RF radiation prevents illicit detection and decoding of information which is being entered via the keyboard.

30 Claims, 1 Drawing Sheet

KEYBOARD, ESPECIALLY FOR ELECTRONIC DATA-PROCESSING APPARATUSES

BACKGROUND OF THE INVENTION

The invention relates to a keyboard, especially for electronic data-processing apparatuses.

A multiplicity of electronic apparatuses, such as visual display units, are controlled via keyboards. In general a keyboard consists of a separate keyboard housing which is arranged in front of the electronic apparatus and has one or more control panels which project out of the housing, such as, for example, a typewriter keyboard, in which individual keys or key switches, in each case arranged in columns and rows, are arranged. The individual keys or key switches themselves may be soldered onto a common board which is fitted with electronic components, especially microprocessors. Each key switch has allocated to it one or more meanings, such as, for example, letters, digits or the like, which are initiated by key operation. In order to differentiate between the individual keys, said keys are coded in, for example, binary signals. The key which has been operated is converted via, for example, a serial interface into a specific binary code, 8 to 10 binary bits in the form of square-wave pulses normally being used. In this bit pattern, the individual keys are unambiguously allocated with respect to one another on the basis of their function. The allocation with respect to one another in this case takes place by means of a microprocessor on the board.

The microprocessors operate, for example, at a clock frequency of between 1 and 6 MHz, that is to say, at 6 MHz, and a switching process takes place 6 times per microsecond. These switching processes, which run at a high switching speed, cause radio-frequency interference which triggers the computer or the microprocessor. A spectrum of interference frequencies is accordingly produced which frequencies, depending on the coding and the system of key interrogation, contain information which can be allocated unambiguously to the character entered on the keyboard. This interference is, on the one hand, radiated directly into the air and, on the other hand, is emitted to the environment via the keyboard cable and the computer connected thereto, as conducted interference.

A certain amount of shielding of the board holding the individual key switches is achieved by providing a metal frame, constructed from flat sheet metal, in which the housings of the key switches are inserted. In consequence, a reduction in the interference level values is already achieved. However, in practice, radio-frequency interference can still occur, as in the past, to such a severe extent that it is possible to intercept these frequencies. This can lead to undesired detection of data and information by unauthorized personnel.

A housing for electronic apparatuses has been disclosed in DE 20 32 408 B 2, whose electromagnetic radiation to the outside is shielded and which is shielded against electromagnetic radiation from the outside. This is done by means of two shell parts, which are produced from plastic, are plugged one inside the other and form a type of double wall. In this arrangement, the inner shell part is provided with a metal surface.

This known embodiment may achieve a significant reduction in the electromagnetic radiation which possibly emerges to the outside. However, it is extraordinarily expensive. Furthermore, the consequent implementation of the radiation shielding in the region of the key guide has not been continued.

GB 1,550,758 has likewise disclosed a keyboard arrangement whose electronic circuits are intended to be protected against static electrical discharges. For this purpose, comprehensive measures are provided for grounding, that is to say current dissipation. This document does not mention any consideration of RF radiation.

DE OS 39 18 951 A 1 has disclosed a shielding housing for a general application, in which housing the emergence of radio-frequency radiation is prevented, or at least reduced, by sharply-angled deflection edges being provided for the RF radiation. The emergence of radio-frequency radiation from a housing is accordingly prevented by a sharply-edged connection or joint or by means of a plurality of abrupt angles. In this arrangement, the intermediate spaces between the housing parts must be kept as small as possible. An electrically conductive material such as aluminum, brass or copper is proposed as the material for the known shielding housing.

SUMMARY OF THE INVENTION

The invention is based on the object of avoiding the disadvantages in the case of known apparatuses in the shielding of radio-frequency radiation and, in particular, of creating a keyboard, especially for electronic visual display units, which offers optimum shielding of RF radiation. The keyboard according to the invention is intended to be shielded, particularly towards the outside, in such a manner that RF frequencies which can be detected and decoded can no longer emerge at all. To the extent that said frequencies nevertheless emerge, they are intended to lie in a frequency band which cannot be detected.

In comparison with known keyboards, the invention has the advantage that it makes possible large-scale and optimum compartmentalization of the RF signals occurring in the keyboard to the outside, that is to say the interference level can be reduced in comparison with conventional keyboards by such an amount that this noise level is less than the cosmic noise which is present all the time. In consequence, RF interference frequencies emerging from the keyboard can no longer be analyzed by unauthorized personnel. The optimum compartmentalization of the keyboard results from measured value analyses using known apparatuses.

BRIEF DESCRIPTION OF THE DRAWINGS

More precise details of the invention are shown in the drawing and are explained in more detail, with an indication of further advantages, in the following description Of an exemplary embodiment, in which.

DESCRIPTION OF THE PREFERRED EMBODIMENTS

Figure 1:
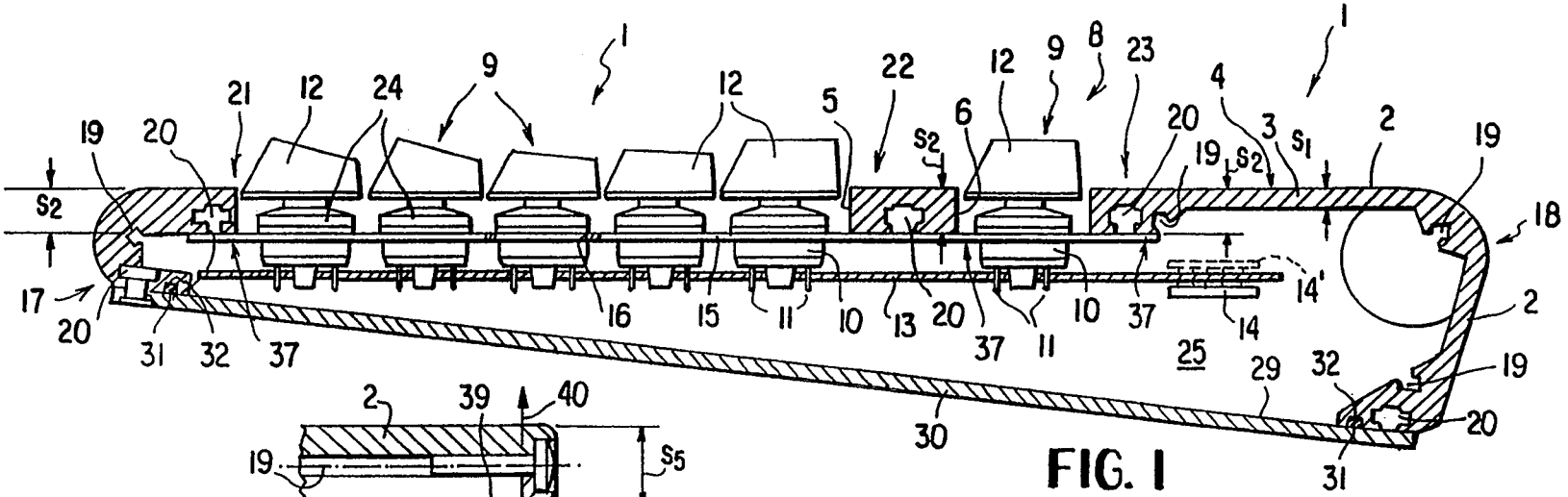
FIG. 1 show a side section through a keyboard according to the invention.

The keyboard 1, shown in FIG. 1, for an electronic visual display unit or data-processing apparatus consists of an approximately U-shaped or L-shaped keyboard housing 2 composed of aluminum or electrically conductively coated plastic, having openings or recesses 5, 6 which are incorporated in the wall 3 of the keyboard top 4 and from which control panels 7, 8 project. The control panel 7 comprises, for example, key switches 9 arranged in columns and rows, five key switches arranged in a column being shown in FIG. 1. The control panel 8 comprises, for example, one row of key switches 9 arranged side by side.

Each key switch 9 comprises a dedicated key switch housing 10 with downwardly projecting connecting contacts 11 and upper operating key caps 12.

The individual key switches 9 are soldered onto a common board 13. The board contains the necessary electronic components, such as a microprocessor, for example. In FIG. 1, the components 14 are arranged underneath the board 13. However, they may also be arranged above the board 13, in accordance with the embodiment 14' which is shown in dashed-dotted lines.

The individual key switches 9 are inserted with their housings 10 into a metal frame 15 which is constructed as a flat metal sheet. Metal frame 15 has only the recesses 16 in order to hold the key switch housing 10 without a gap and, for the rest, is completely closed. The metal frame 15 thus already represents a type of shielding of the board 13 located underneath it upwards.

The key housing 2 comprises an aluminum extruded profile having a wall thickness $s_1$ of at least approximately 3.0 mm. In this case, the keyboard housing comprises the keyboard top 4, the chamfered short keyboard front side 17 and the longer keyboard rear side 18. In this case, the extruded profile offers the capability of integrally forming longitudinal grooves 20, which extend over the entire length of the extruded profile cover for the insertion of threaded strips which are not shown in more detail, and screw on channels 19 especially for the end pieces on the sides, that is to say generally for the attachment of further individual parts to the extruded profile.

In the region of the recess 5 on the keyboard top 4, the housing wall thickness $s_2$ is increased to approximately 7 mm. In the exemplary embodiment according to FIG. 1, these are the region 21 located underneath and to the left of the control panel 7, the region 22 located between the control panel 7 and the control panel 8, and the region 23 located above and to the right of the control panel 8. In these regions 21 to 23, of increased wall thickness, threaded strips are inserted into the longitudinal grooves 20 in the extruded profile. In consequence, the metal frame 15 can be screwed onto the keyboard housing 2, 4 at short intervals by means of screws which are not shown in more detail. This connection is designed without a gap. In consequence, RF radiation can no longer pass directly to the outside between the frame 15 and the housing opening 5, 6 for the control panel 7, 8, since, because of the direction-deflecting surfaces 37, any RF radiation passing between the frame 15 and the housing is always reflected on an opposite side of the respective recess 5, 6 and is thus very greatly attenuated. The individual openings in the frame are hence so small that they are virtually not present for the frequency spectrum which occurs in the keyboard. If, for example at relatively high frequencies, even more far-reaching attenuation is required, the tops 24 of the key switches 9 can also be produced from an electrically conductive plastic or can be provided with a conductive coating. Furthermore, all the aluminum parts of the housing are provided with a coating which makes the surface electrically conductive and prevents insulating corrosion. In consequence, large-area, low-resistance contacts are produced at all the connections, which contacts are important for attenuating radio-frequency interference.

The keyboard housing 2, with the front side 17, top 4 and rear side 18, is produced integrally over the entire length of the keyboard 1 as an extruded profile, which represents extremely economical and flexible production.

Figure 2:
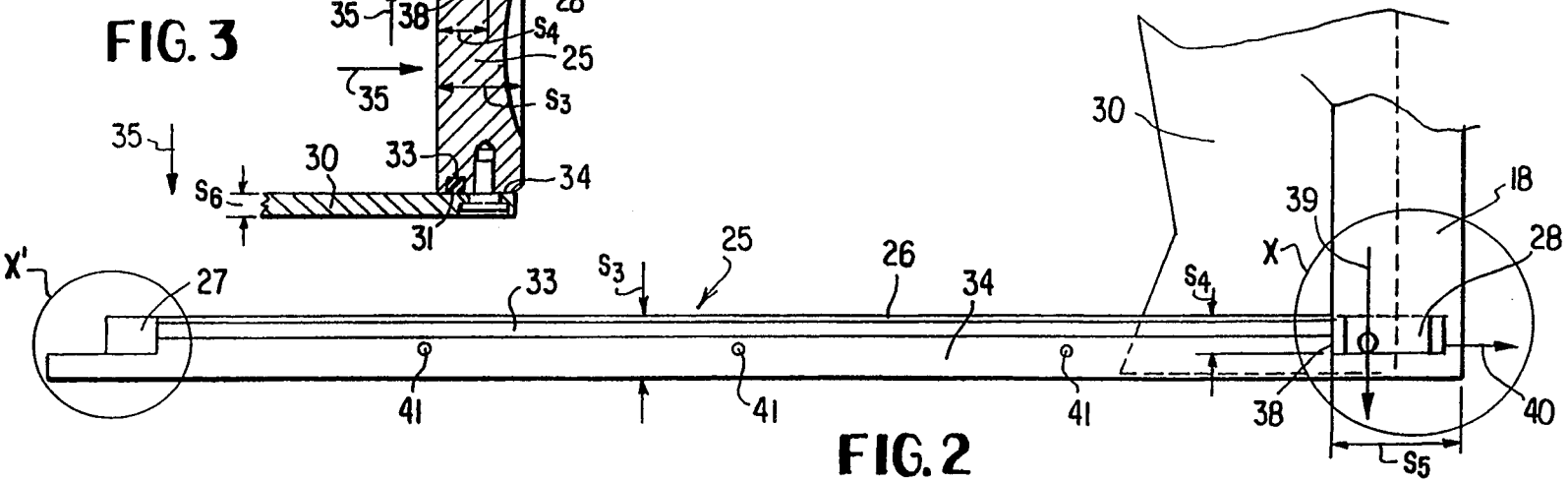
FIG. 2 shows an end piece, which is to be placed on both ends, for closure at the sides.

FIG. 2 shows an end piece 25 which can be inserted into the end which is opposite the end opening, shown in FIG. 1, of the key housing 2. Jig. 3 shows an associated detail of the connection between the end piece 25 and the keyboard housing 2, as well as the housing base or base plate 30.

An end piece which has a corresponding mirror-image form is to be inserted at the end into the end shown in FIG. 1. The end piece 25 has an overall wall thickness $s_3$ of approximately 10 mm and is likewise produced from a metal which shields RF radiation. The end piece 25 has peripheral milled surfaces 26 to 28 which dip or extend into the keyboard housing 2, 4, 17, 18 and form a plurality of wall sections 38 there for multiple right-angled deflection of RF radiation. Merely microfine intermediate gaps may be present, because of the precise manufacture. The radiation is always deflected in such a gap, which leads to high attenuation.

Figure 3:
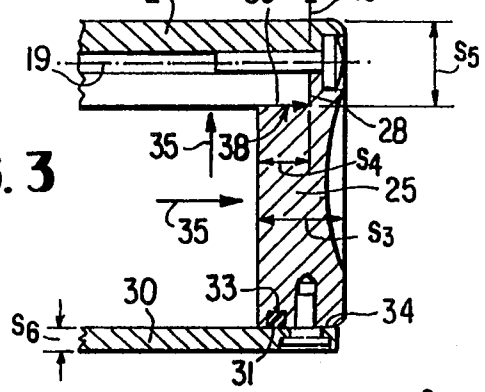
FIG. 3 shows a section through a corner region of the housing in the region of the detail X in FIG. 2.

The end pieces 25 are screwed onto the keyboard front side 17, the keyboard top 4 and the keyboard rear side 18 via the screwing-on channels 19. The two end pieces 25 at the ends are precisely matched in their side view to the profile of the keyboard housing 2 and are terminated at the bottom opening 29 of housing 2 in a flush manner. A metallic housing base 30 which closes the key housing 2 underneath then only needs to be screwed in from underneath onto the threaded strips in the longitudinal grooves 20 in the lower region of the front side 17 and of the rear side 18, and into additional holes 41 in the end pieces 25. The housing base 30 is sealed by means of an elastic, electrically conductive RF seal 31, the underside of the keyboard housing 2 having corresponding longitudinal recesses 32. A corresponding recess 33 for the insertion of the RF seal 31 is provided at the bottom 34 of each end piece 25. The path of the RF radiation with respect to the end piece 25 is shown in FIGS. 2 and 3 by an arrow 35. The RF radiation emerging from the keyboard housing is reduced to a minimum by multiple deflection as a result of the housing construction. The RF radiation is deflected at right angles along the arrows 39, 40 (see FIGS. 2 and 3) because of the wall sections 38 which enter or penetrate into the housing 2. In the same way, the wall thickness contributes to a very high level of absorption of the radiation. The wall thickness $s_3$ of the end piece 25 is $s_3 \approx 10$ mm. The wall section 38 which dips in has a width $s_4 \approx 6$ mm. The thickness of the housing in the deflection region is $s_5 \approx 7$ mm. The base plate 30 has a thickness $s_6 \approx 2.5$ mm.

Because the end piece 25 and the keyboard housing 2 dip or extend into one another, the RF radiation is deflected so that severe attenuation occurs. The shielding, which is good overall, thus prevents transmission of interference radiation to the outside and the ingress of radiation from the outside to the inside. This applies to both electrical and to electromagnetic radiation. The keyboard according to the invention is therefore suitable as an interception-proof keyboard in important fields of use.

The representation according to FIG. 3 corresponds, in principle, to the dipping-in region of the end piece 25 which is shown on the right-hand side of the Figures in FIGS. 1 and 2. This region is represented by "X" in FIG. 2. The region "X"' which is represented on the left-hand side in FIG. 2 is of identical construction, in principle.

The invention is not limited to the exemplary embodiment which is described and shown. It also comprises all the specialist developments in the context of the core idea according to the invention.

We claim:

1. A keyboard, comprising:

an L-shaped outer keyboard housing having an open bottom side and two open ends;

closure means for closing the keyboard housing on all sides to provide a high level of RF radiation shielding, the closure means including a frame and a housing base to seal the open bottom side of the keyboard housing; and a control panel which is arranged on the top of the keyboard housing, the control panel including individual key switches which emit key-specific RF signals when they are operated, each key switch having an individual key housing and being inserted into matched recesses in the frame, the frame surrounding the individual key switches with at most a small gap, wherein the frame is mounted without a gap on the keyboard housing, wherein the internal space of the keyboard is connected to the region outside the keyboard only via direction-deflecting surfaces or via very small gaps, wherein the keyboard additionally includes a common circuit board and at least one electronic device on the common board, the individual key switches being connected directly to the common board, the common board being arranged in the keyboard housing, wherein the keyboard housing is produced from an extruded profile which is integral over its entire length, wherein the closure means additionally includes two metallic end pieces, each of which dips into and is mounted in an end of the keyboard housing, is matched to the profile of the keyboard housing, and terminates flush with the housing base, wherein the housing base is constructed as a covering plate and is mounted from underneath in the lower region of the front side and rear side of the keyboard housing and of the end pieces, wherein a recess for the control panel is located in a wall of the keyboard top of the keyboard housing, wherein the frame holding the key switches is mounted directly on the underside of the wall of the keyboard top in the region surrounding the recess, and wherein all the direction-deflecting surfaces and very small gaps between the keyboard housing and, respectively, the frame, the housing base and the end pieces, are provided at surfaces which contact with one another.

2. The keyboard as claimed in claim 1, wherein the L-shaped keyboard housing comprises a keyboard front side, a keyboard top and a keyboard rear side having a minimum wall thickness of $s_1 \approx 3.0$ mm.

3. The keyboard as claim in claim 1, wherein the two end pieces have milled portions which deflect the direction of RF radiation a plurality of times and dip into the keyboard housing.

4. The keyboard as claimed in claim 1, wherein the housing base comprises an aluminum covering plate having a wall thickness of $s_6 \approx 2.5$ mm and an RF metal seal.

5. The keyboard as claimed in claim 1, wherein the keyboard housing has portions with a wall thickness $s_2 \approx 7$ mm in the region of the recess for the control panel, into which channels are formed over the entire length of the extruded profile.

6. The keyboard as claimed in claim 5, wherein the frame is mounted by means which extend into the channels.

7. The keyboard as claimed in claim 1, wherein the key switches have upper parts which are electrically conductive.

8. The keyboard as claimed in claim 1, wherein the keyboard housing, the housing base, and the end plates are made from aluminum and are provided with a coating which makes their surfaces electrically conductive.

9. The keyboard as claimed in claim 8, wherein large-area, low-resistance contacts are produced at all the connections between the individual surfaces.

10. The keyboard as claimed in claim 1, wherein at least one of the keyboard housing and the housing base is produced from a plastic which is electrically conductive on its surface.

11. The keyboard as claimed in claim 1, wherein the keyboard housing has a front, top and rear, and wherein the mounting of the end pieces takes place by screws which extend into screw-on channels which are provided in the keyboard housing and which are located in the keyboard housing front, keyboard housing top, and keyboard housing rear.

12. The keyboard as claimed in claim 1, wherein the keyboard housing has a front and a rear, and wherein the housing base is mounted by screws which extend into threaded strips that are lodged in channels which are located in the keyboard front and the keyboard rear, as well as screws which extend into additional holes in the end pieces.

13. A keyboard, comprising:

a U-shaped outer keyboard housing having an open bottom side and two open ends;

closure means for closing the keyboard housing on all sides to provide a high level of RF radiation shielding, the closure means including a frame and a housing base to seal the open bottom side of the keyboard housing; and a control panel which is arranged on the top of the keyboard housing, the control panel including individual key switches which emit key-specific RF signals when they are operated, each key switch having an individual key housing and being inserted into matched recesses in the frame, the frame surrounding the individual key switches with at most a small gap, wherein the frame is mounted without a gap on the keyboard housing, wherein the internal space of the keyboard is connected to the region outside the keyboard only via direction-deflecting surfaces or via very small gaps, wherein the keyboard additionally includes a common circuit board and at least one electronic device on the common board, the individual key switches being connected directly to the common board, the common board being arranged in the keyboard housing, wherein the keyboard housing is produced from an extruded profile which is integral over its entire length, wherein the closure means additionally includes two metallic end pieces, each of which dips into and is mounted in an end of the keyboard housing, is matched to the profile of the keyboard housing, and terminates flush with the housing base, wherein the housing base is constructed as a covering plate and is mounted from underneath in the lower region of the front side and rear side of the keyboard housing and of the end pieces, wherein a recess for the control panel is located in a wall of the keyboard top of the keyboard housing, wherein the frame holding the key switches is mounted directly on the underside of the wall of the keyboard top, in the region surrounding the recess, and wherein all the direction-deflecting surfaces and very small gaps between the keyboard housing and, respectively, the frame, the housing base and the end pieces, are provided at surfaces which contact with one another.

14. The keyboard as claimed in claim 13, wherein the U-shaped keyboard housing comprises a keyboard front side, a keyboard top and a keyboard rear side having a minimum wall thickness of $s_1 \approx 3.0$ mm.

15. The keyboard as claim in claim 13, wherein the two end pieces have milled portions which deflect the direction of RF radiation a plurality of times and dip into the keyboard housing.

16. The keyboard as claimed in claim 13, wherein the housing base comprises an aluminum covering plate having a wall thickness of $s_6 \approx 2.5$ mm and an RF metal seal.

17. The keyboard as claimed in claim 13, wherein the keyboard housing has portions with a wall thickness $s_2 \approx 7$ mm in the region of the recess for the control panel, into which channels are formed over the entire length of the extruded profile.

18. The keyboard as claimed in claim 17, wherein the frame is mounted by means which extend into the channels.

19. The keyboard as claimed in claim 13, wherein the key switches have upper parts which are electrically conductive.

20. The keyboard as claimed in claim 13, wherein the keyboard housing, the housing base, and the end plates are made from aluminum and are provided with a coating which makes their surfaces electrically conductive.

21. The keyboard as claimed in claim 20, wherein large-area, low-resistance contacts are produced at all the connections between the individual surfaces.

22. The keyboard as claimed in claim 13, wherein at least one of the keyboard housing and the housing base is produced from a plastic which is electrically conductive on its surface.

23. The keyboard as claimed in claim 13, wherein the keyboard housing has a front, top and rear, and wherein the mounting of the end pieces takes place by screws which extend into screw-on channels which are provided in the keyboard housing and which are located in the keyboard housing front, keyboard housing top, and keyboard housing rear.

24. The keyboard as claimed in claim 13, wherein the keyboard housing has a front and a rear, and wherein the housing base is mounted by screws which extend into threaded strips that are lodged in channels which are located in the keyboard front and the keyboard rear, as well as screws which extend into additional holes in the end pieces.

25. A keyboard, comprising:

a circuit board;

a plurality of key switches which are electrically connected to the circuit board and which emit RF radiation when they are operated, each key switch having a key switch housing; and an enclosure in which the circuit board is disposed, the enclosure being made from a plurality of electrically conductive enclosure elements which are joined so as to contact one another at contact surfaces, the enclosure elements including a keyboard housing with a predetermined profile, the keyboard housing having a top side with a wall and a bottom side which is open, the keyboard housing additionally having two open ends, the wall at the top side of the keyboard housing having an opening, a base plate closing the bottom side of the keyboard housing, two end plates having upper edges which match the profile of the keyboard housing and having bottom edges which terminate flush with the base plate, each end plate closing a respective end of the keyboard housing and having a portion which protrudes inward into the keyboard housing past the respective end, and a frame mounted on the wall at the top side of the housing beneath the opening in the wall, the frame having openings through which the key switches extend, the openings being dimensioned to snugly receive the key switch housings, wherein the contact surfaces of the enclosure elements are selected from the group consisting of very small gaps and direction-deflecting surfaces, so that any RF radiation escaping from the enclosure between the keyboard housing and the base plate, between the keyboard housing and the end plates, between the keyboard housing and the frame, or between the base plate and the end plates is attenuated.

26. The keyboard of claim 25, wherein the predetermined profile of the keyboard housing is L-shaped.

27. The keyboard of claim 25, wherein the predetermined profile of the keyboard housing is U-shaped.

28. The keyboard of claim 25, wherein the keyboard housing is made from an elongated extruded member having a configuration which is uniform over its entire length.

29. The keyboard of claim 28, wherein the opening in the wall at the top side of the keyboard housing has front and rear sides, wherein the wall at the top side of the keyboard housing has longitudinal grooves adjacent the front and rear sides of the opening, wherein threaded strips are lodged into the grooves, and wherein the frame is a flat member which is mounted by screws that engage the threaded strips.

30. The keyboard of claim 29, wherein the keyboard housing has a screw-on channel at a position spaced apart from the opening, and further comprising a screw which extends through an opening in an end plate into the screw-on channel.

* * * * *